US005207860A

United States Patent [19]

Klaassen et al.

[11] Patent Number: 5,207,860

[45] Date of Patent: May 4, 1993

[54] TAPE HOLDER AND DISPENSER

[75] Inventors: Willem Klaassen, St. Michelsgestel, Netherlands; Christoph Manusch, Hemmingen, Fed. Rep. of Germany

[73] Assignee: Pelikan Aktiengesellschaft, Hanover, Fed. Rep. of Germany

[21] Appl. No.: 739,157

[22] Filed: Jul. 31, 1991

[30] Foreign Application Priority Data

Jul. 31, 1990 [NL] Netherlands ..... 9001733

[51] Int. Cl.[5] ..... B32B 31/00

[52] U.S. Cl. ..... 156/526; 156/574; 156/579

[58] Field of Search ..... 156/526, 574, 576, 579, 156/582, DIG. 48; 118/40, 43, 249, 260

[56] References Cited

U.S. PATENT DOCUMENTS

| | | | |
|---|---|---|---|
| 1,442,058 | 1/1923 | Emmert et al. | 83/233 |
| 2,230,016 | 1/1941 | Roberts | 156/526 |
| 2,518,184 | 8/1950 | Renne | 156/526 |
| 2,556,443 | 6/1951 | Renne | 156/526 |
| 2,586,835 | 2/1952 | Leger | 156/526 |
| 3,204,949 | 9/1965 | Kieslich | 493/419 |
| 3,466,963 | 9/1969 | Paison et al. | 280/723 |

FOREIGN PATENT DOCUMENTS 2061281 6/1971 France .

*Primary Examiner*—David A. Simmons
*Assistant Examiner*—James J. Engel, Jr.
*Attorney, Agent, or Firm*—Herbert Dubno; Andrew Wilford

[57] ABSTRACT

A tape-applying apparatus has a housing adapted to hold a roll of tape, a feed unit actuatable for paying out a piece of the tape, a cutter actuatable for cutting off the piece of tape payed out by the feed unit, an actuating lever displaceable inward and outward between start and finish end positions and through an intermediate position, and a spring braced between the lever and the housing and urging the lever into the start end position. The lever is connected to the feed unit during inward travel of the lever from the start to the intermediate position for actuating the feed unit with the lever and paying out a piece of the tape and is connected to the cutter only during inward travel of the lever between the intermediate and finish positions for cutting off the piece of tape payed out.

14 Claims, 12 Drawing Sheets

TAPE HOLDER AND DISPENSER

FIELD OF THE INVENTION

The present invention relates to a tape holder. More particularly this invention concerns an apparatus that can hold pressure-type tape and that can also be used to dispense and apply it directly to a substrate.

BACKGROUND OF THE INVENTION

A standard tape applicator or holder has a housing provided with a roll supply of tape, with a feed system for paying out the tape, and with a cutter for cutting off the payed out piece of tape. Such devices are described in German patent documents DE-Al-3,109,735, DE-Al-2,801,540, French FR-A-2,061,281, European EP-A-92,187 and EP-A-207,868, and in U.S. Pat. Nos. 1,442,058, 3,204,949, 3,466,963.

The known devices do indeed make it fairly easy to apply the tape directly to a substrate. To this end a small projecting end of the tape is pressed by the apparatus down against the substrate and the apparatus is pulled along the substrate, thereby simultaneously paying out and applying the tape to the substrate. At the end the device is actuated to cut off the applied piece, leaving a small tip of the tape exposed on the apparatus for the next use.

If on the contrary the user merely needs a piece of tape to apply manually to something, it is fairly difficult and frequently impossible to feed out and pull off such a piece. Doing so often requires the user to work immediately adjacent the cutting arrangement with his or her fingers, with the possibility of injury inherent in doing so.

OBJECTS OF THE INVENTION

It is therefore an object of the present invention to provide an improved tape applier and dispenser.

Another object is the provision of such an improved tape applier and dispenser which overcomes the above-given disadvantages, that is which can be used to apply a piece of tape directly to a substrate, and that can also be used to dispense a piece of tape for application by the user.

SUMMARY OF THE INVENTION

A tape-applying apparatus according to this invention has a housing adapted to hold a roll of tape, a feed unit actuatable for paying out a piece of the tape, a cutter actuatable for cutting off the piece of tape payed out by the feed unit, an actuating lever displaceable inward and outward between start and finish end positions and through an intermediate position, and a spring braced between the lever and the housing and urging the lever into the start end position. According to the invention the lever is connected to the feed unit during inward travel of the lever from the start to the intermediate position for actuating the feed unit with the lever and paying out a piece of the tape and is connected to the cutter only during inward travel of the lever between the intermediate and finish positions for cutting off the piece of tape payed out.

Thus it is possible to actuate the lever one or more times between the start and intermediate position to pump out any desired length of the tape. Only once the desired length is payed out, is the lever pushed all the way down to cut it off. It is also possible to use the device as a tape applicator by pressing the tape against some thing and simply pulling it along until the desired amount of tape has been pulled out of the housing, whereupon the lever can be pushed in to cut it off.

According to another feature of this invention during travel of the lever between the intermediate and finish positions this lever covers the cutter so as to make it inaccessible and prevent the user from being injured by it as it is actuated. In addition the lever has an end that engages the sticky side of the payed-out piece of tape in the finish position so that when the payed-out piece of tape is cut off it is left adhered to the end of the lever.

Furthermore in accordance with the invention an applicator roller is displaceable on the housing between an outer and an inner position. The tape passes over this applicator roller and a spring urges it into the outer position. The applicator roller is coupled to the cutter so that actuation of the cutter is inhibited so long as the applicator roller is in the inner position but the cutter is actuated on displacement of the applicator roller from the outer to the inner position. Thus when the device is pressed against a substrate to apply a piece of tape, the cutter is automatically operated not by the lever but by lifting of the applicator.

According to another feature of this invention outward travel of the lever is inhibited after same has traveled inward past the intermediate position and until same has traveled inward to the finish end position. This means can be constituted as an inwardly deflectable rack or sector gear carried on the lever and provided with sawteeth that form a one-way coupling with sawteeth of a gear train of the feed unit.

In accordance with further features of the invention the housing has an intermediate partition wall to one side of which is provided the tape roll, the lever, and the cutter, and to the other side of which is provided the coupler. Furthermore, the lever is provided with a feed sector gear and with a cutting sector gear connectable via the coupler to the feed unit and cutter. The lever also has a retaining sector gear forming part of the retaining means that inhibit outward travel of the lever after same has traveled inward past the intermediate position and until same has traveled inward to the finish end position.

The feed unit of this invention comprises upstream and downstream feed rollers immediately adjacent each other and both engaging one side of the tape, gears for codirectionally rotating both of the feed rollers but for rotating the downstream roller faster than the upstream roller, and an idler roller engaging the other side of the tape and pressing the tape into radially outwardly open grooves of the feed rollers. Means is provided for inhibiting reverse rotation of the feed rollers. This can be a one-way clutch/brake arrangement, or can be as simple as applying the feed rollers to the sticky side of the tape so that the tape's inherent resistance to unwinding prevents reverse rotation of the feed wheels.

The housing can include a removable cartridge holding the roll of tape. This cartridge in turn is set up to pay out a piece of tape on insertion of the cartridge into the housing.

In accordance with a feature of this invention the lever travels a predetermined feed distance on movement between the start end position and the intermediate position and a predetermined cutting distance on movement between the intermediate position and the finish end position. The feed distance is four to nine times longer than the cutting distance. Thus it is possible to pump out a piece of tape fairly easily without worrying about pushing too far and cutting it off.

BRIEF DESCRIPTION OF THE DRAWING

The above and other objects, features, and ad will become more readily apparent from the following, reference being made to the accompanying drawing in which.

SPECIFIC DESCRIPTION

Figure 1:
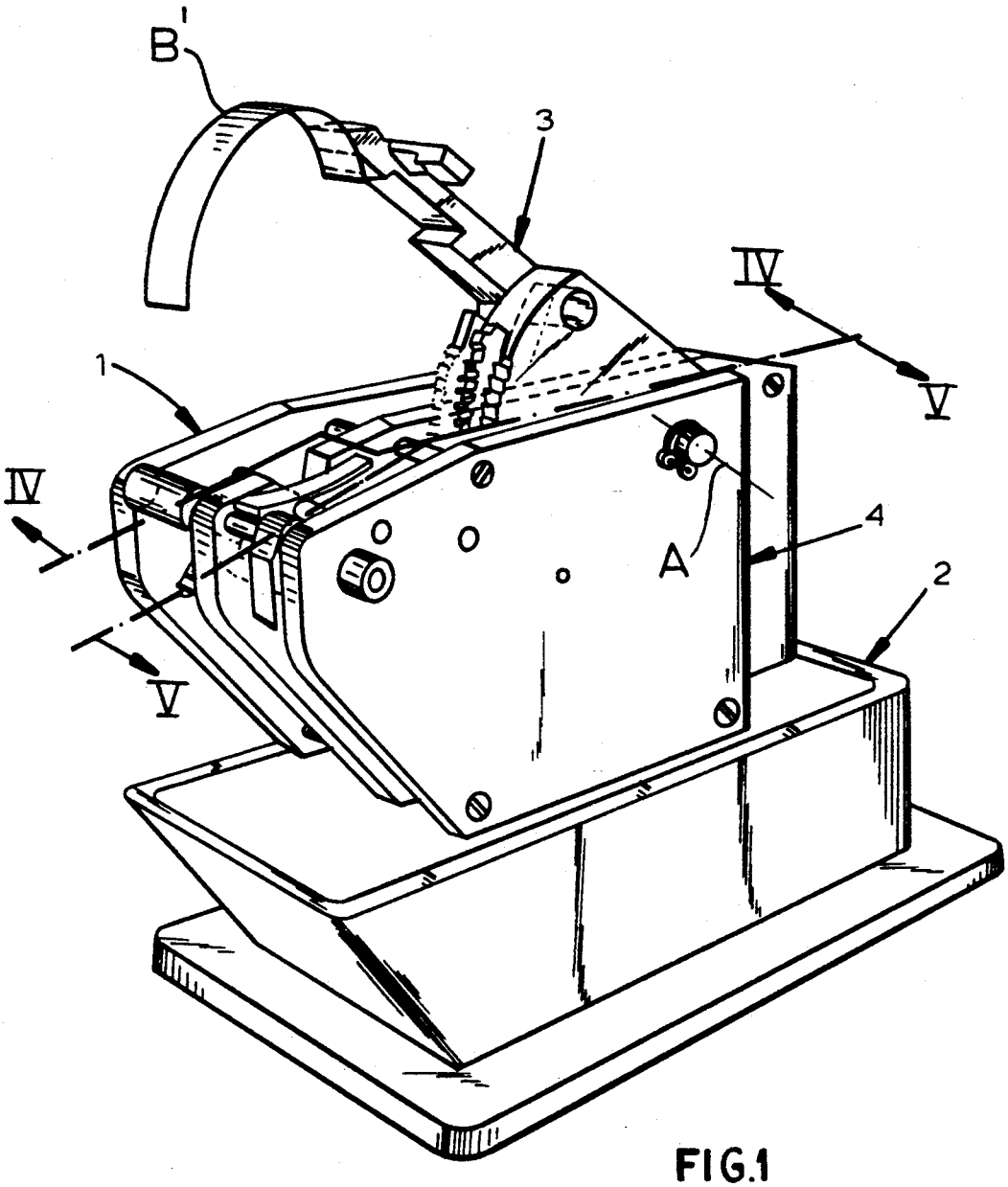
FIG. 1 is a perspective view of the apparatus of this invention dispensing a piece of tape.
Figure 2:
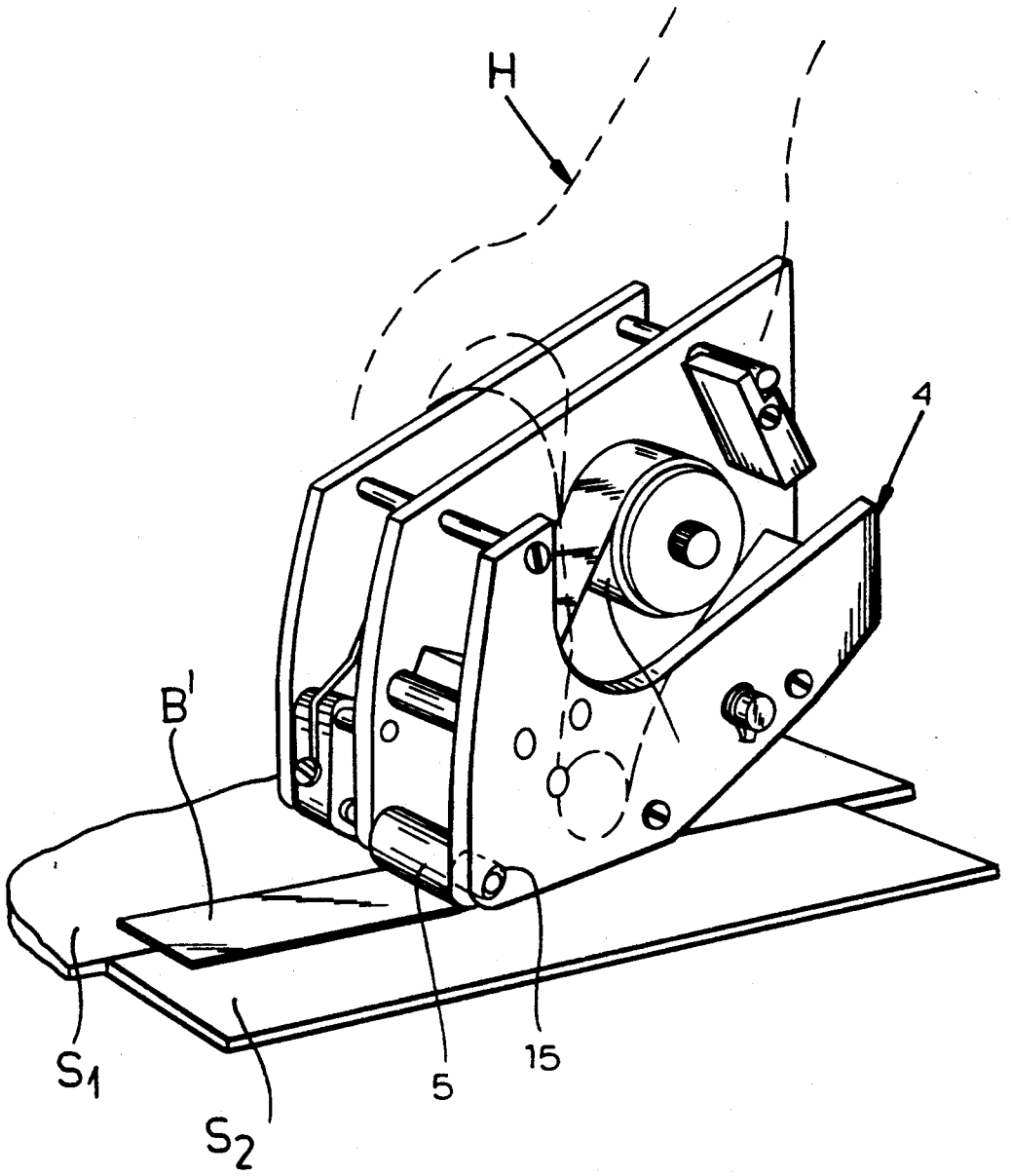
FIG. 2 is a view of the apparatus being used to apply a piece of tape to a substrate.
Figure 6:
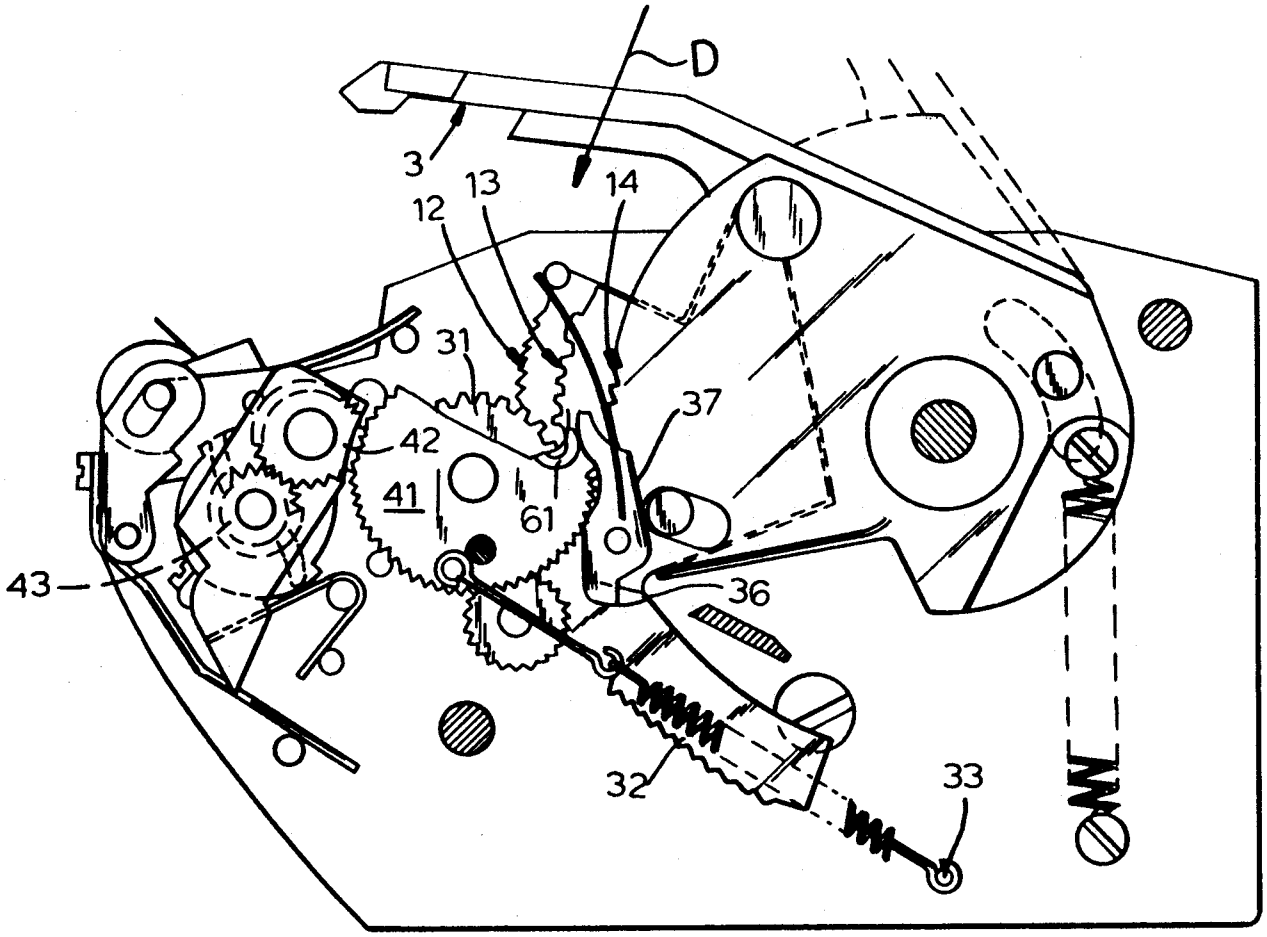
FIGS. 6 through 10 are views like FIG. 5 but in different positions and with different elements cut away for clarity of view, FIGS. 7 and 8 showing the elements in the same position and FIGS. 9 and 10 similarly showing the elements in the same position.
Figure 7:
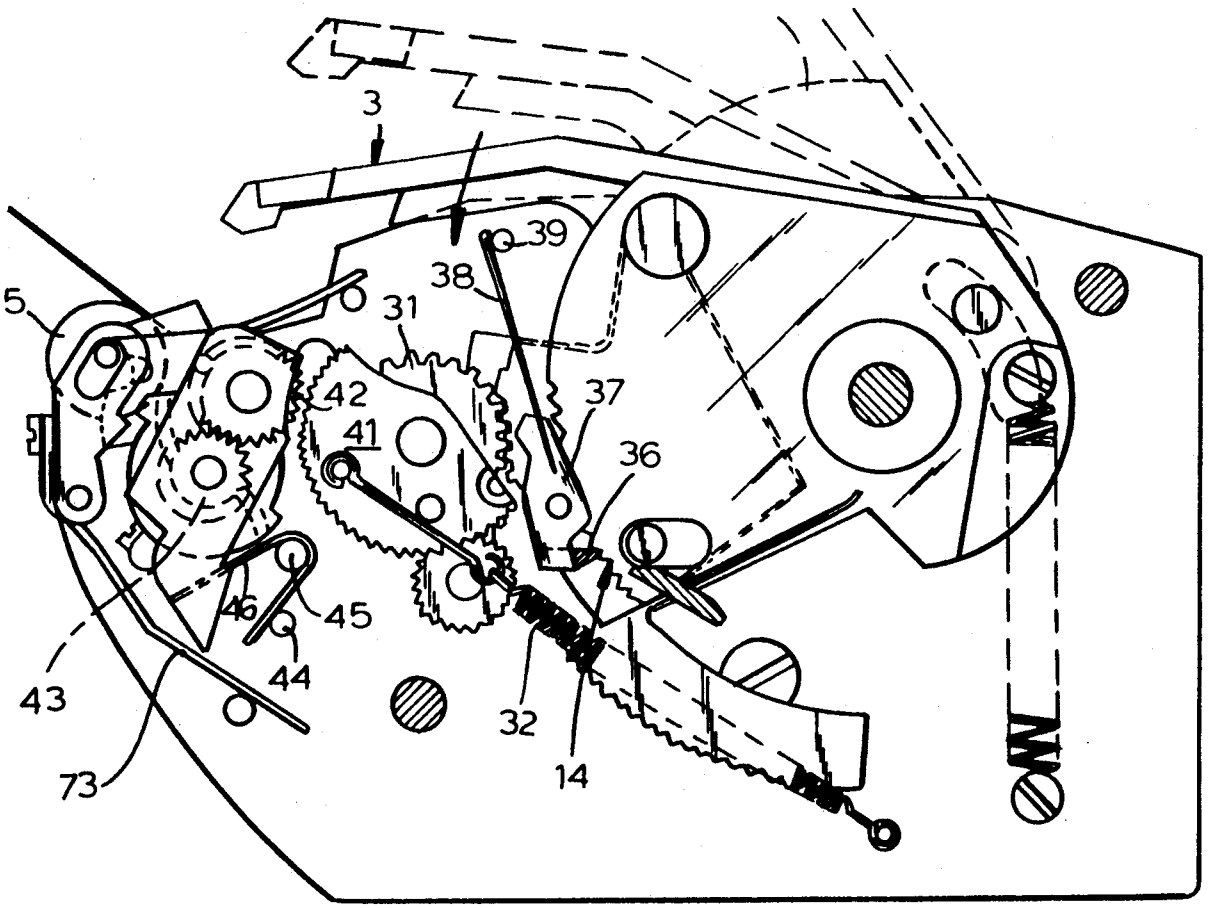
Figure 8:
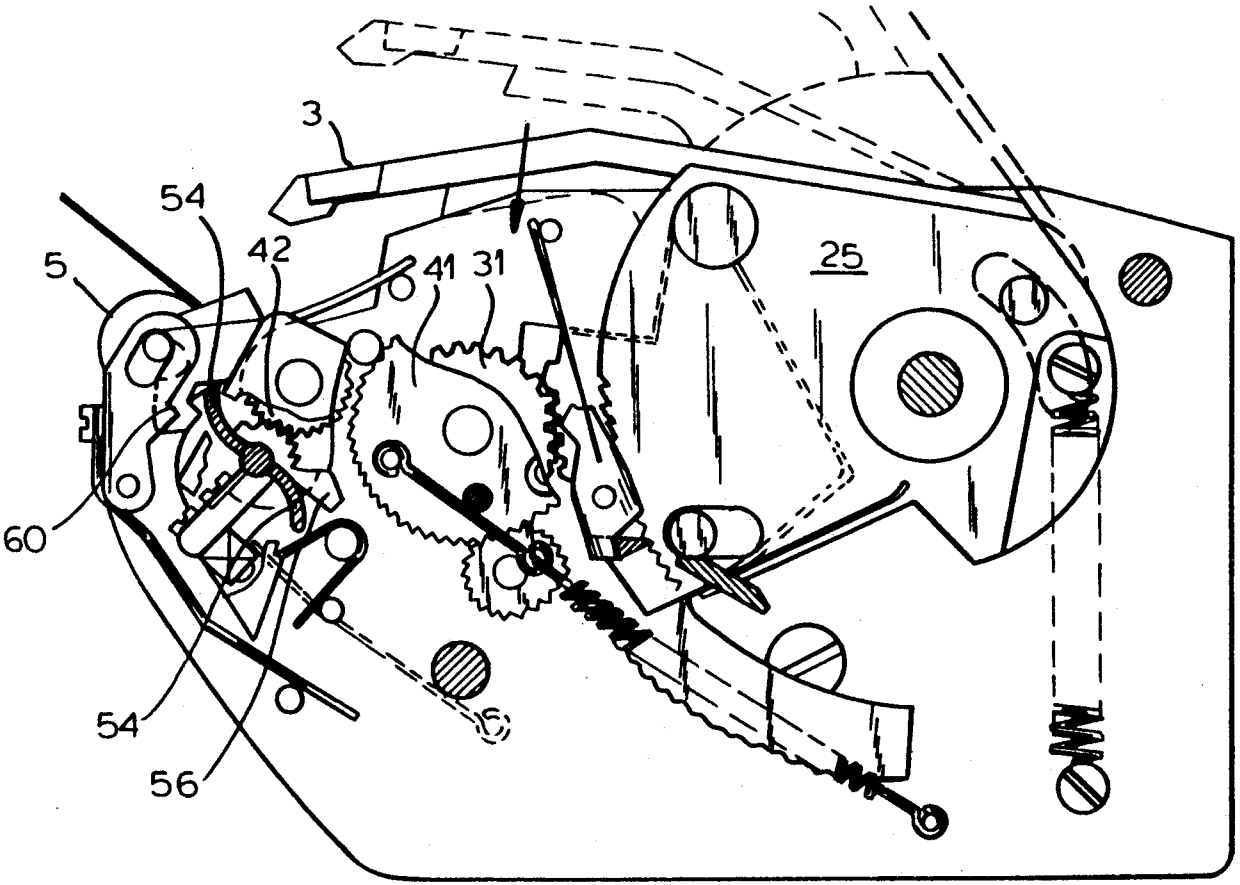

As seen in FIGS. 1 and 2 a tape holder 1 for dispensing and applying tape basically has a housing 4 which can be mounted in a desktop holder 2 (FIG. 1) or inverted and held in a hand H (FIG. 2). This housing 4 is normally surrounded by a decorative case that dresses up its appearance but is irrelevant to the instant invention so that it is not shown here. An actuating lever 3 is pivoted on an axle 10 about an axis A on the housing adjacent a supply roll R of tape B whose one side is covered with pressure-sensitive adhesive. For stationary use of the device as seen in FIG. 1 this lever 3 is pushed down as indicated by arrow D (FIG. 6) to push out a piece of the tape B and is connected with a transmission 6 to a mechanism 7 that serves to pay out the tape B. When mounted in the holder the system can simply dispense cut pieces B' of the tape B, but when inverted and held as shown in FIG. 2 it can be used to apply the tape B to adjacent substrates $S_1$ and $S_2$. The housing 4 is provided with an intermediate partition wall 11 to one side of which is provided the lever 3 and the supply roll R and to the other side of which are held the various gears and mechanisms described below. The tape B passes over an applicator roller 5 mounted in slots 15 formed in the housing 4 in all modes of use. A spring 29 continuously biases the roller 5 outward.

The lever 3 carries an abutment pin 48 that rides in a part-circular slot in the housing 4 to limit and define the angular range of movement of this lever 3, and a spring 49 continuously biases the lever 3 against the actuation direction D, that is upward out of the housing 4 as seen in the drawing. This lever 3 is fixed to a sector block 25 having a sector 20 responsible for paying out the tape B, a sector 22 that actuates a cutting mechanism 26, and a sector 23 that serves to retain the lever 3 and block 25 when pushed down beyond a predetermined limit. The sector 20 is pivoted at 19 on the block 25 and has a lateral projection 21 fitting in a slot in the block 25 for limited pivoting of this block 25 to disengage it on return travel against the direction D as described below. An abutment 28 in the housing 4 engages the projection 21 to pull the sector 20 back in through its play 24 at the lower end of travel of the sector block 25.

Figure 4:
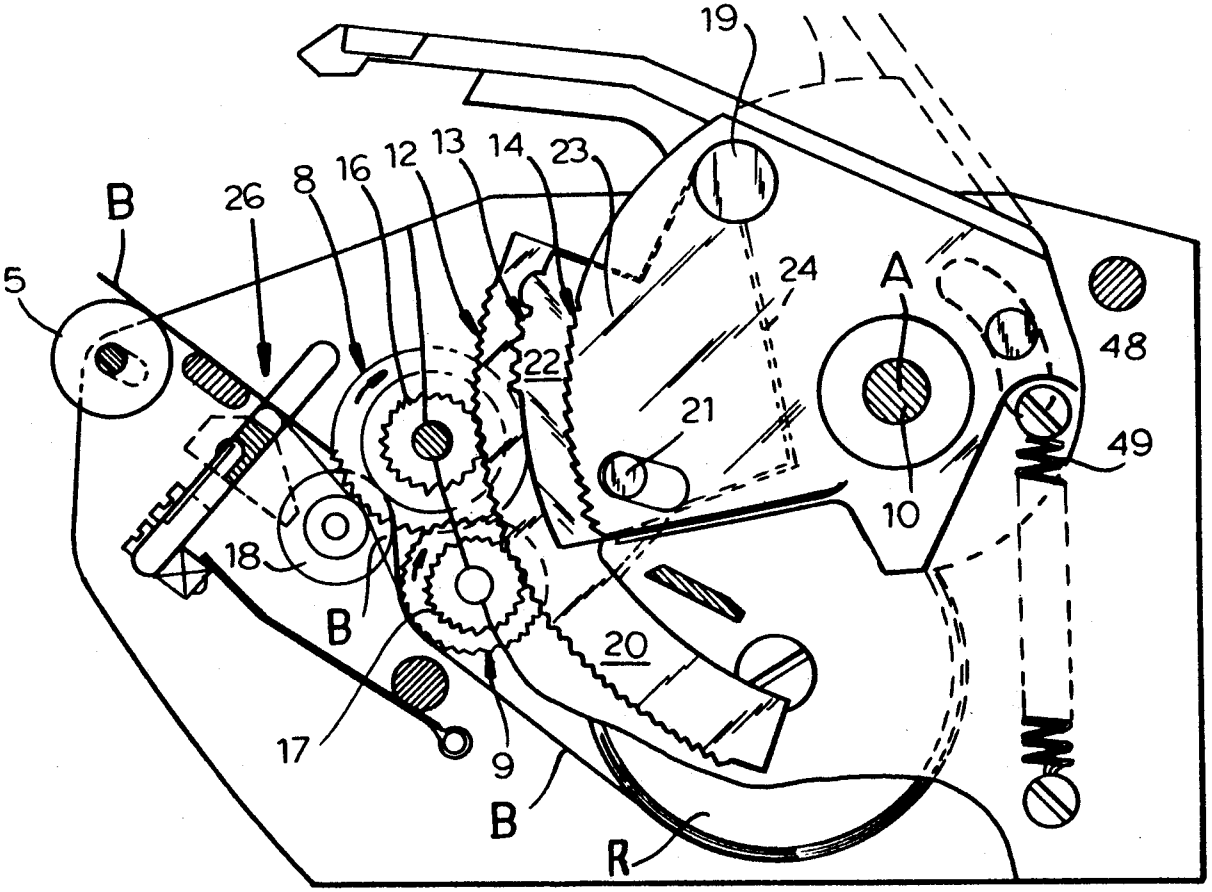
FIGS. 4 and 5 are sections taken respectively along lines IV—IV and V—V of FIG. 1 but with the apparatus in slightly different positions.
Figure 5:
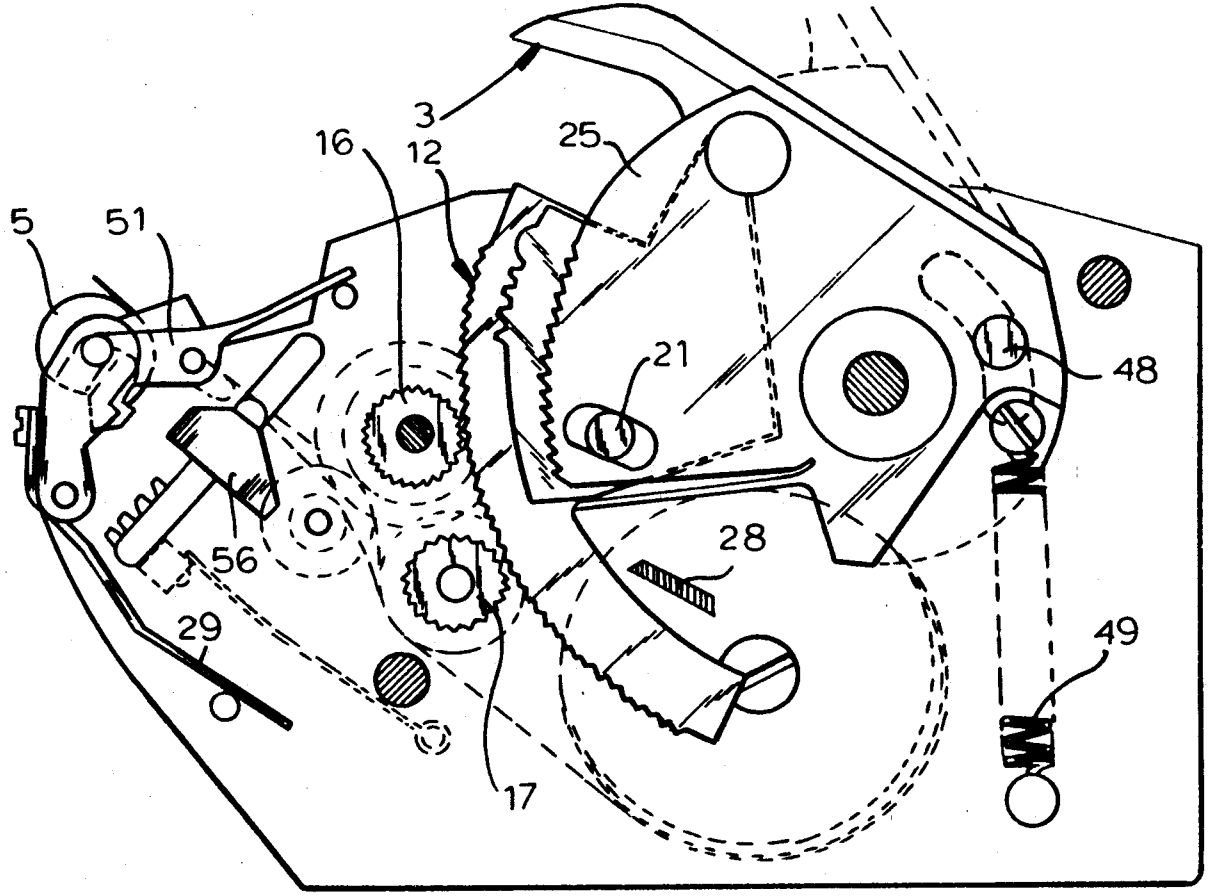

The pay-out sector 20 has sawteeth 12 that mesh as seen in FIG. 4 with two gear wheels 16 and 17 fixed to and coaxial with respective feed rollers 8 and 9 between which the tape B passes. The wheel 8 is of larger diameter than the wheel 9 so its peripheral speed is greater, and an idler wheel 18 engages in radially outwardly open grooves in the two wheels 8 and 9 to put a longitudinal fold in the tape B and stiffen it. The surfaces of the wheels 8 and 9 are ridged parallel to their rotation axes so that the tape B does not stick to them well, and their different peripheral speeds further inhibits the sticky side of the tape B from adhering to the wheel 9.

The cutting sector 22 has teeth 13 only in an uppermost region that can mesh with a wheel 31 coaxial with and fixed to a gear 41 in turn meshing with a gear 42 that itself meshes with a gear 43 carried on an actuator wheel 55. A spring 32 is anchored at one end at 33 to the housing 4 and at its opposite end at an eccentric point on the wheel 41 to store up force that is used as described below in the tape-cutting operation. The teeth 13 can only mesh with and rotate the gears 41 through 43 when the lever 3 and the sector block 25 have been rotated through a predetermined angle in the direction D. A hairpin spring 46 stretched 15 over pins 44 and 45 urges the gear 42 into mesh with the gear 41. Thus if the lever 3 is pumped through a lesser angle the downward motions will rotate the rollers 8 and 9 to pay out the tape B and the upward motions will occur with the teeth 12 sliding on the gears 16 and 17, so that a fairly long piece of the tape B can be payed out. This sector 22 is also pivoted on the sector block 25 and is pushed back at the end of the block's travel by the abutment 28 as described below.

The retaining sector 23 has sawteeth 14 which can be engaged by a tooth 36 of a latch or retaining element 37 pivoted on the housing. Like the teeth 13, these teeth 14 are only provided at the upper portion of the sector 23 so that they will only engage the element 37 when the lever 3 has been pushed down in the direction D beyond a certain point which in fact corresponds generally to the point when the teeth 13 start to rotate the wheel 31. When the tooth 36 of the element 37 engages in the teeth 14, upward movement against the direction D is impossible. The element 37 is provided with a leaf spring 38 that bears at 39 against the housing 4 to urge it continuously into engagement with the sector 23.

Figure 3:
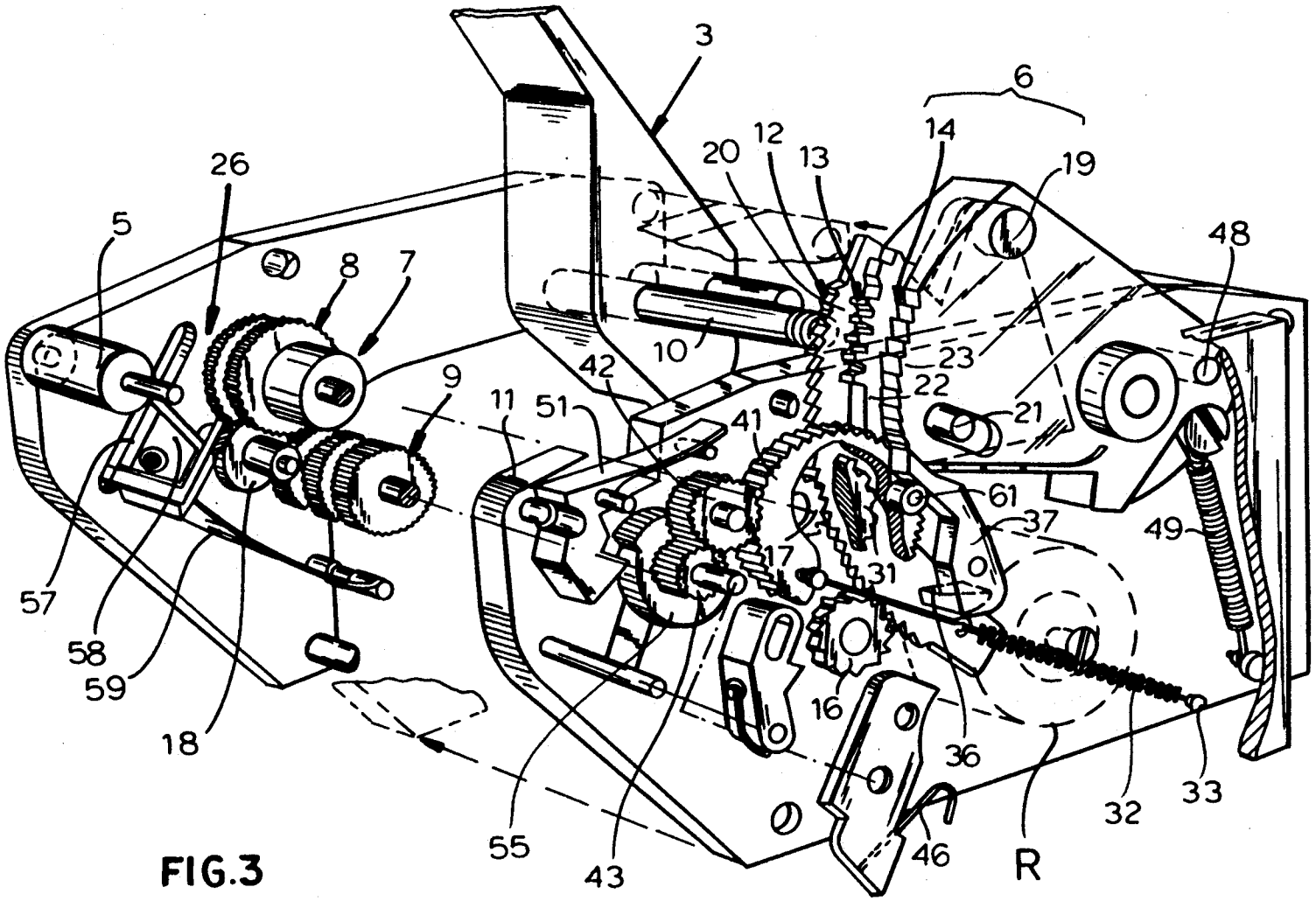
FIG. 3 is an exploded perspective view of the apparatus.
Figure 9:
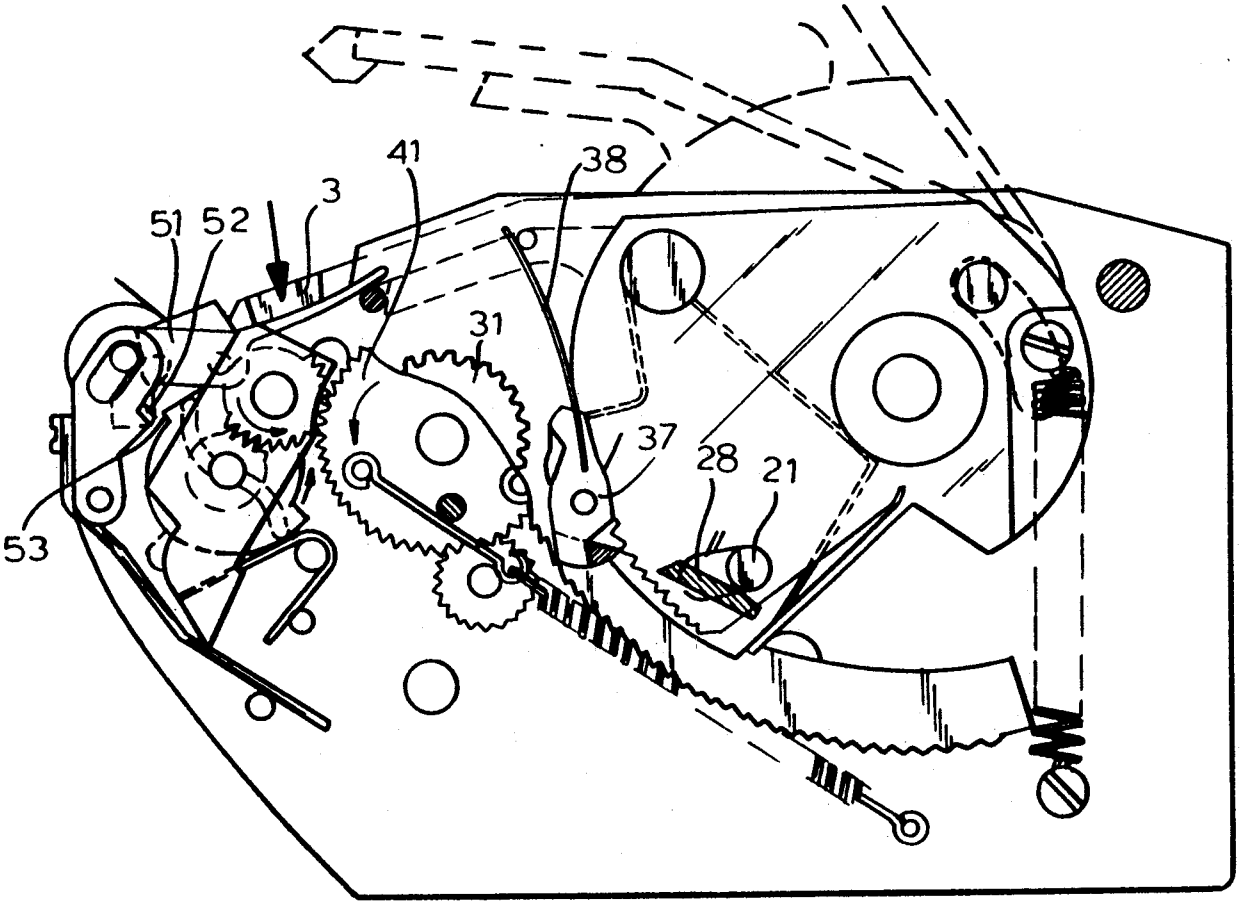
Figure 10:
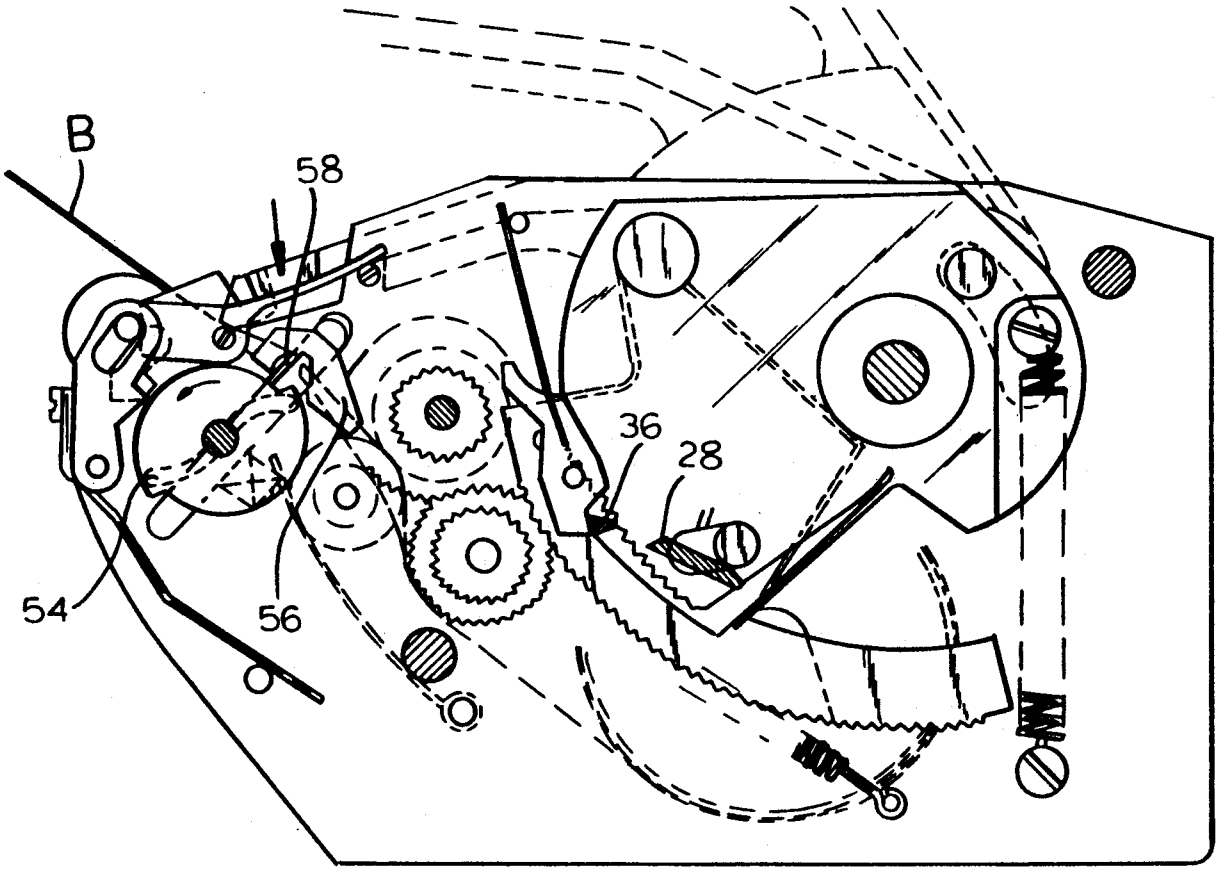

The cutting mechanism 26 includes arms 54 on the wheel 55 that normally block a part 56 of a holder 57 (FIG. 3) of a blade 58. The holder 57 is carried on a leaf spring 59. The wheel 55 in turn carries two diametrally opposite abutments 53 that can be blocked from rotating by a tooth 52 of a release element 51. When the lever 3 is pushed all the way in, its outer end engages an extension of the element 51 to rotate it clockwise as seen in FIG. 9, thereby disengaging the teeth 52 and 53 so that the spring forces stored up in the springs 59 and 32 are effective to snap the blade 58 over and cut throuqh the tape B, leaving a piece B' adhered to the end of the lever 3 as indicated in FIG. 1.

Once the wheel 55 has rotated through half a revolution, of course entraining with it the gears 41 through 43, a pin 61 on the wheel 41 engages the upper end of the retaining lever 37 and rocks it clockwise, thereby pulling its tooth 36 out of engagement with the teeth 14. This action releases the lever 3 to rise up again opposite the direction D under the force of the spring 48.

When the applicator is used inverted as shown in FIG. 2, the end of the lever 3 is pushed in to also push in the retaining element 51. In addition the roller 5 is pushed in so an element 60 on it prevents actuation of the cutting mechanism 26 until the applicator is lifted and the roller 5 pops out again under spring force. Thus as soon as the apparatus is lifted, the cutting mechanism 26 operates to cut the tape B.

Figure 11:
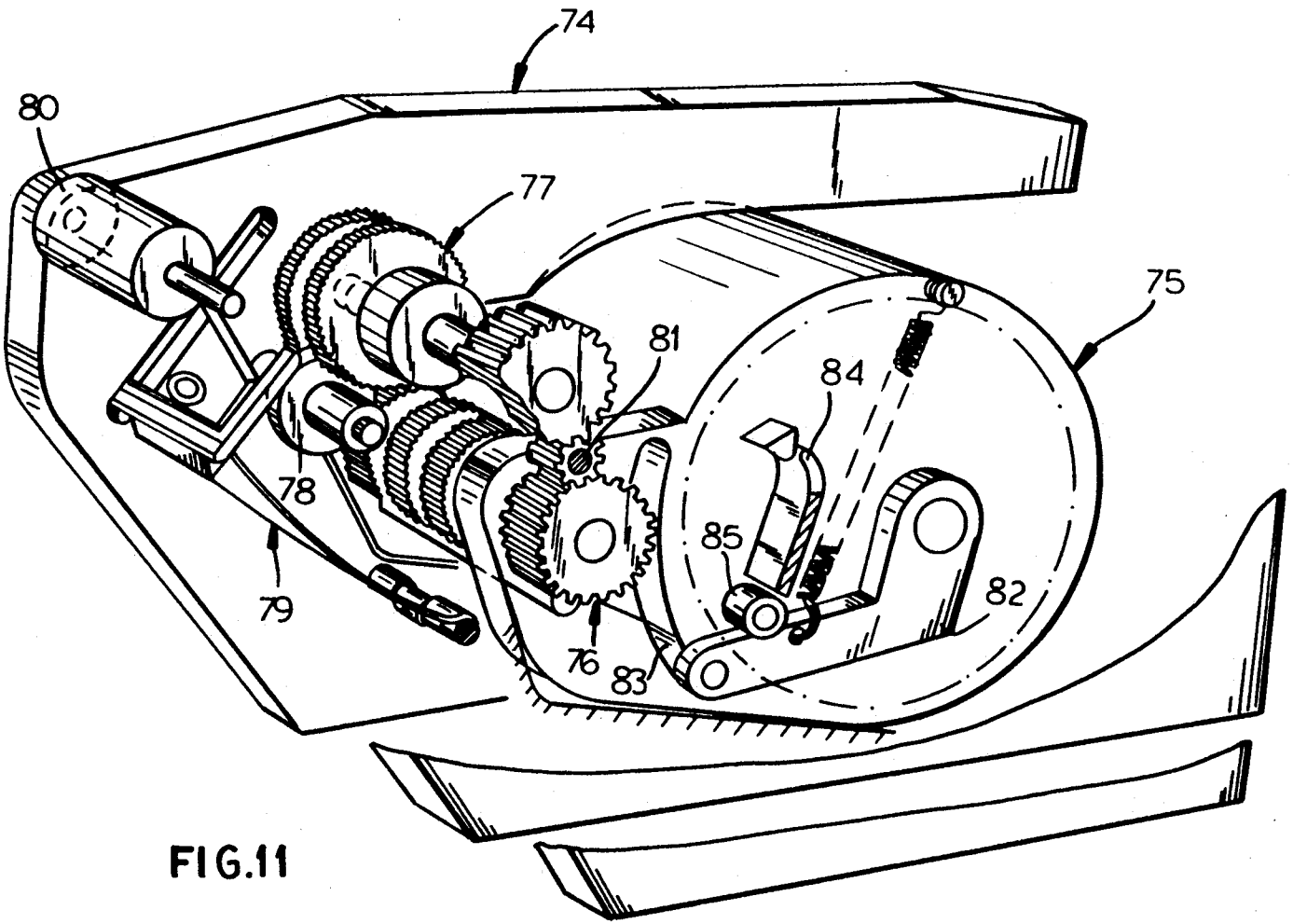
FIG. 11 is a perspective sectional view of another apparatus according to the invention.

FIG. 11 shows a further embodiment of the invention. This system has feed wheels 76 provided in a cassette 75 that is provided with the unillustrated supply roll. The housing 74 has further feed wheels 77, an intermediate wheel 78, a cutting device 79, and an applicator roll 80. Between the first and second feed wheels 76 and 77 is a gear 81 for transmitting force applied by the lever 3 to the second wheel 77 to the first wheel 76 but in the same direction. The cassette 75 is preferably provided with a spring-loaded lever 82 which has a transverse arm 83 for paying out the tape once the cartridge is inserted in the housing, that is so that the tape can be fed between the rollers 76 and 77 to the wheel 80. On insertion of the cartridge 75 the lever 82 contacts an abutment 84 and presses down a wheel 85 so that the arm 83 rolls out the tape and forms a loose loop in the cartridge 75.

Figure 12:
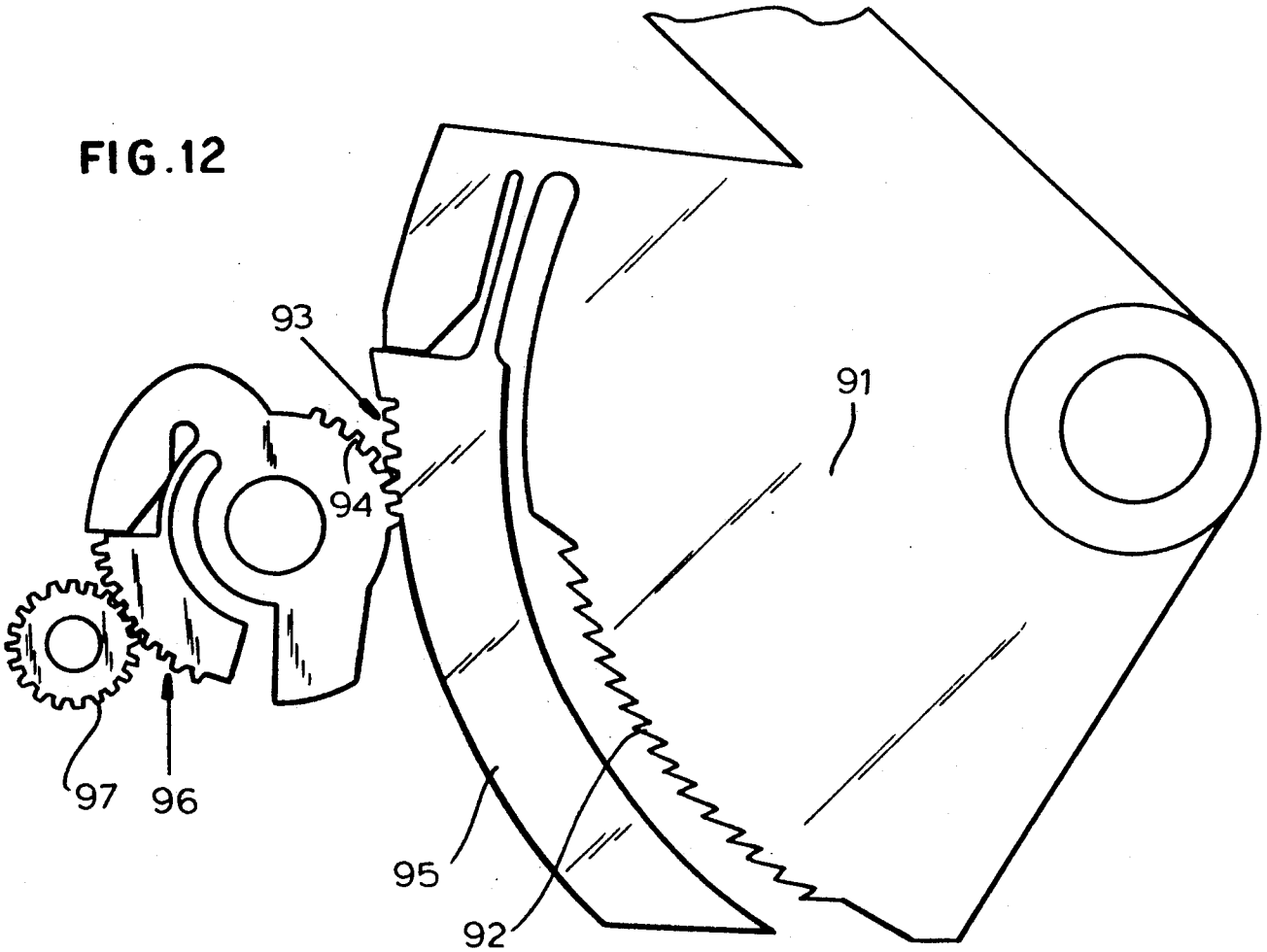
FIG. 12 is a large-scale schematic view of a detail of FIG. 11.

In FIG. 12 a sector block 91 is provided with a toothing 93 carried on a deflectable element 95 and is also directly provided with a latching toothing 92. The toothing 93, which serves to actuate an unillustrated cutter, meshes with teeth 94 of a wheel having a deflectable sector 96 in turn meshing with the teeth of a wheel 97. This wheel 97 in turn cooperates with further structure not illustrated here.

We claim:

1. A tape-applying apparatus comprising:
a housing adapted to hold a roll of tape;
feed means actuatable for paying out a piece of the tape;
cutting means actuatable for cutting off the piece of tape payed out by the feed means, the cutting means including
a blade displaceable transversely through the tape,
spring means carrying the blade on the housing and tensionable to urge the blade transversely of the tape, and
blocking means including a formation operatively engageable with the blade to retain same against the force of the spring means at a spacing from the tape;
an actuating lever displaceable inward and outward between start and finish end positions and through an intermediate position;
a spring braced between the lever and the housing and urging the lever into the start end position; and
coupling means for connecting the lever to the feed means during inward travel of the lever from the start to the intermediate position, for actuating the feed means with the lever and paying out a piece of the tape, and for connecting the lever to the spring and blocking means of the cutting means only during inward travel of the lever between the intermediate and finish positions for tensioning the spring means and then releasing the blocking means for cutting off the piece of tape payed out, whereby the blade is held back against spring force and only released when the lever moves generally into the finish position.

2. The tape-applying apparatus defined in claim 1 wherein during travel of the lever between the intermediate and finish positions the lever covers the cutting means and prevents access to it from outside, whereby a user of the apparatus is protected from injury by the cutting means.

3. A tape-applying apparatus comprising:
a housing adapted to hold a roll of tape;
feed means actuatable for paying out a piece of the tape;
cutting means actuatable for cutting off the piece of tape payed out by the feed means;
an actuating lever displaceable inward and outward between start and finish end positions and through an intermediate position, the tape having a sticky side and the lever having an end that engages the sticky side of the payed-out piece of tape in the finish position;
a spring braced between the lever and the housing and urging the lever into the start end position; and
coupling means for connecting the lever to the feed means during inward travel of the lever from the start to the intermediate position for actuating the feed means with the lever and paying out a piece of the tape and for connecting the lever to the cutting means only during inward travel of the lever between the intermediate and finish positions for cutting off the piece of tape payed out, whereby when the payed-out piece of tape is cut off it is left adhered to the end of the lever.

4. A tape-applying apparatus comprising:
a housing adapted to hold a roll of tape;
feed means actuatable for paying out a piece of the tape;
cutting means actuatable for cutting off the piece of tape payed out by the feed means;
an actuating lever displaceable inward and outward between start and finish end positions and through an intermediate position;
a spring braced between the lever and the housing and urging the lever into the start end position;
coupling means for connecting the lever to the feed means during inward travel of the lever from the start to the intermediate position for actuating the feed means with the lever and paying out a piece of the tape and for connecting the lever to the cutting means only during inward travel of the lever between the intermediate and finish positions for cutting off the piece of tape payed out, the lever being provided with a feed sector gear and with a cutting sector gear connectable via the coupling means to the feed means and cutting means;
an applicator roller displaceable on the housing between an outer and an inner position, the tape passing over the applicator roller;
a spring urging the applicator roller into the outer position; and
means including retaining formations on the applicator roller, housing, and cutting means for
inhibiting actuation of the cutting means when the applicator roller is in the inner position and for
actuating the cutting means on displacement of the applicator roller from the outer to the inner position.

5. A tape-applying apparatus comprising:
a housing adapted to hold a roll of tape;
feed means actuatable for paying out a piece of the tape;

cutting means actuatable for cutting off the piece of tape payed out by the feed means;

an actuating lever displaceable inward and outward between start and finish end positions and through an intermediate position;

a spring braced between the lever and the housing and urging the lever into the start end position;

coupling means for connecting the lever to the feed means during inward travel of the lever from the start to the intermediate position for actuating the feed means with the lever and paying out a piece of the tape and for connecting the lever to the cutting means only during inward travel of the lever between the intermediate and finish positions for cutting off the piece of tape payed out, the lever being provided with a feed sector gear and with a cutting sector gear connectable via the coupling means to the feed means and cutting means; and retaining means for inhibiting outward travel of the lever after same has traveled inward past the intermediate position and until same has traveled inward to the finish end position.

6. The tape-applying apparatus defined in claim 1 wherein the housing has an intermediate partition wall to one side of which is provided the tape roll, the lever, and the cutting means, and to the other side of which is provided the coupling means.

7. The tape-applying apparatus defined in claim 1 wherein the lever is provided with a feed sector gear and with a cutting sector gear connectable via the coupling means to the feed means and cutting means.

8. The tape-applying apparatus defined in claim 7 wherein the lever is provided with a retaining sector gear forming part of the retaining means.

9. A tape-applying apparatus comprising:

housing adapted to hold a roll of tape;

feed means actuatable for paying out a piece of the tape;

cutting means actuatable for cutting off the piece of tape payed out by the feed means;

an actuating lever displaceable inward and outward between start and finish end positions and through an intermediate position;

a spring braced between the lever and the housing and urging the lever into the start end position;

coupling means for connecting the lever to the feed means during inward travel of the lever from the start to the intermediate position for actuating the feed means with the lever and paying out a piece of the tape and for connecting the lever to the cutting means only during inward travel of the lever between the intermediate and finish positions for cutting off the piece of tape payed out, the lever being provided with a feed sector gear and with a cutting sector gear connectable via the coupling means to the feed means and cutting means, the feed sector gear having sawteeth and being deflectable out of engagement with the coupling means; and means for deflecting the feed sector gear out of engagement with the coupling means on outward travel of the lever.

10. A tape-applying apparatus comprising:

a housing adapted to hold a roll of tape;

feed means actuatable for paying out a piece of the tape and including upstream and downstream feed rollers immediately adjacent each other, each formed with a radially outwardly open groove, and both engaging one side of the tape, gear means for codirectionally rotating both of the feed rollers but for rotating the downstream roller faster than the upstream roller, and an idler roller engaging the other side of the tape, projecting radially into the grooves of the feed rollers, pressing the tape into the grooves of the feed rollers, and thereby longitudinally folding and stiffening the tape;

cutting means actuatable for cutting off the piece of tape payed out by the feed means;

an actuating lever displaceable inward and outward between start and finish end positions and through an intermediate position;

a spring braced between the lever and the housing and urging the lever into the start end position; and coupling means for connecting the lever to the feed means during inward travel of the lever from the start to the intermediate position for actuating the feed means with the lever and paying out a piece of the tape and for connecting the lever to the cutting means only during inward travel of the lever between the intermediate and finish positions for cutting off the piece of tape payed out, the lever being provided with a feed sector gear and with a cutting sector gear connectable via the coupling means to the feed means and cutting means.

11. The tape-applying apparatus defined in claim 1 wherein the housing includes a removable cartridge holding the roll of tape.

12. A tape-applying apparatus comprising:

a housing including a removable cartridge holding a roll of tape and provided with means for paying out a piece of tape on insertion of the cartridge into the housing;

feed means in the housing outside the cartridge actuatable for paying out a piece of the tape;

cutting means actuatable for cutting off the piece of tape payed out by the feed means;

an actuating lever displaceable inward and outward between start and finish end positions and through an intermediate position;

a spring braced between the lever and the housing and urging the lever into the start end position; and coupling means for connecting the lever to the feed means during inward travel of the lever from the start to the intermediate position for actuating the feed means with the lever and paying out a piece of the tape and for connecting the lever to the cutting means only during inward travel of the lever between the intermediate and finish positions for cutting off the piece of tape payed out, the lever being provided with a feed sector gear and with a cutting sector gear connectable via the coupling means to the feed means and cutting means.

13. The tape-applying apparatus defined in claim 1 wherein the feed means includes:

upstream and downstream feed rollers immediately adjacent each other and both engaging one side of the tape;

gear means for codirectionally forwardly rotating both of the feed rollers but for rotating the downstream roller faster than the upstream roller;

an idler roller engaging the other side of the tape and pressing the tape against the feed rollers; and means for inhibiting reverse rotation of the feed rollers.

14. The tape-applying apparatus defined in claim 1 wherein the lever travels a predetermined feed distance on movement between the start end position and the intermediate position and a predetermined cutting distance on movement between the intermediate position and the finish end position, the feed distance being four to nine times longer than the cutting distance.

* * * * *